United States Patent [19]

Sirinyan et al.

[11] Patent Number: 4,764,401

[45] Date of Patent: Aug. 16, 1988

[54] PROCESS FOR ACTIVATING SUBSTRATE SURFACES FOR ELECTROLESS METALLIZATION

[75] Inventors: Kirkor Sirinyan, Leverkusen; Henning Giesecke, Cologne; Gerhard D. Wolf, Dormagen; Harold Ebneth; Rudolf Merten, both of Leverkusen, all of Fed. Rep. of Germany

[73] Assignee: Bayer Aktiengesellschaft, Leverkusen, Fed. Rep. of Germany

[21] Appl. No.: 7,706

[22] Filed: Jan. 28, 1987

Related U.S. Application Data

[63] Continuation of Ser. No. 779,192, Sep. 23, 1985, abandoned, which is a continuation of Ser. No. 444,927, Nov. 26, 1982, abandoned.

[30] Foreign Application Priority Data

Dec. 8, 1981 [DE] Fed. Rep. of Germany ..... 3148280

[51] Int. Cl.[4] ..... B05D 3/04; B05D 3/10; B05D 1/18

[52] U.S. Cl. ..... 427/304; 427/305; 427/306; 427/443.1; 427/307

[58] Field of Search ..... 106/111; 427/304

[56] References Cited

U.S. PATENT DOCUMENTS

| | | | |
|---|---|---|---|
| 3,560,257 | 2/1971 | Schneble | 427/305 |
| 3,684,534 | 8/1972 | Emerson | 427/304 |
| 4,006,047 | 2/1977 | Brummett et al. | 427/304 |

FOREIGN PATENT DOCUMENTS

| | | |
|---|---|---|
| 2527096 | 1/1976 | Fed. Rep. of Germany . |
| 564093 | 5/1975 | Switzerland . |
| 592160 | 7/1977 | Switzerland . |
| 1154152 | 6/1969 | United Kingdom . |

OTHER PUBLICATIONS

"Cyclohexadien-(1.3)-cyclopentadien-palladium(O)", Ernst ).Fischer und Helmut Werner, Chemishe Berichte Jahrg.93,1960, pp. 2075-2082.

The Organic Chemistry of Palladium, Vol. II Catalytic Reactions 1971, pp. 8-9.

*Primary Examiner*—Norman Morgenstern
*Assistant Examiner*—Margaret Burke
*Attorney, Agent, or Firm*—Sprung Horn Kramer & Woods

[57] ABSTRACT

A mild and simple process of activating substrate surfaces for the purpose of currentless metallization comprises using organometallic compounds of elements of the groups 1B and 8 of the Periodic System of Elements whose organic moiety has at least one functional group over and above the groups required for binding the metal are used for activation.

17 Claims, No Drawings

PROCESS FOR ACTIVATING SUBSTRATE SURFACES FOR ELECTROLESS METALLIZATION

This is a continuation of application Ser. No. 779,192, filed 9/23/85, now abandoned, which is a continuation of Ser. No. 444,927, filed 11/26/82, now abandoned.

This invention relates to a process for the activation of substrate surfaces for the purpose of chemical metallisation.

It is known that polymer materials must be pretreated prior to chemical and subsequent galvanic metallisation (see R Weiner "Kunststoff Galvanisierung", publishers Eugen G. Leuze Verlag, Saulgau Wurtt. (1973)). These pretreatments generally consist of etching of the polymer surface, e.g. with chromosulphuric acid, simple and repeated rinsing with water, detoxication with dilute sodium bisulphite solution, further rinsing with water and treatment of the substrate surface with a suitable activating bath such as a palladium salt solution or a palladium sol.

Etching changes the polymer surface so that pits and vacuoles are formed. This is only possible with certain polymers, e.g. diphasic multi-component graft or copolymers such as ABS polymers, high impact strength polystyrene or diphasic homopolymers such as partially crystalline polypropylene. Furthermore, the employment of chromosulphuric acid or other oxidants is accomplished by a deterioration in the physical properties such as the notched impact strength and electric surface resistance of the basic polymer material.

In addition, hexavalent chromium carried into the activating and metallising baths poisons the baths.

The same disadvantages are found in methods in which the polymer surfaces are chemically changed by means of a powerful gaseous oxidizing agent such as hot $SO_3$ vapour.

The ionogenic palladium fixed to the surface of the substrate must be reduced to the metal to enable the metal ion to be catalytically reduced in the chemical metallising bath. Reduction of ionogenic palladium is carried out either in an acid tin-(II)-chloride bath or by introduction of tin-(II)-chloride into a strongly hydrochloric acid palladium (I) chloride solution.

Since it is necessary to wash the surface of the substrate after reduction of the ionogenic palladium, it may be assumed that a gel of tin hydroxide is formed in the process, which contributes to the additional fixing of palladium.

Excess protective colloid must be removed from the substrate surface in a subsequent operation in order to enable the metal ions, e.g. of copper, nickel, gold and cobalt, to be reduced in the metallising bath by the catalytic action of active palladium centres on the substrate surface.

The known processes for currentless metallisation of materials therefore consists of a comparatively large number of steps and have the further disadvantage that they are limited to those substrates which by virtue of their physical characteristics or chemical composition can be roughened by a physical or chemical process.

It is an object of the present invention to provide a new, gentle and technically simple method of activating substrate surfaces for the purpose of currentless metallisation by means of which it is possible to obtain a firmly adhering metal coating, preferably without prior etching, even on surfaces which are generally difficult to metallize.

The problem is solved by activating the surfaces with organometallic compounds of elements of the groups 1 B and 8 of the Periodic-System of Elements the organic moiety of which has at least one functional group over and above the groups required for binding the metal.

This invention therefore provides a process for the activation of substrate surfaces for the purpose of currentless metallisation, in which the surface to be metallised is wetted with an organometallic compound of elements of groups 1 B and 8 of the Periodic Systems of Elements homogeneously distributed in a solvent, in particular an organic solvent, the solvent is removed, and the organometallic compound adhering to the surface to be metallised is removed, characterised in that the organic moiety of the organometallic compound has at least one functional group over and above the groups required for binding the metal.

This additional functional group achieves very firm adherence to the substrate surface, which may be due to a chemical reaction with the substrate surface or to adsorption.

Functional groups which are particularly suitable for chemically fixing the activator to the substrate surface are groups such as carboxylic acid groups, carboxylic acid halide groups, carboxylic acid anhydride groups, carboxylic acid ester groups, carbonamide and carbonimide groups, aldehyde and ketone groups, ether groups, sulphonamide groups, sulphonic acid groups and sulphonate groups, sulphonic acid halide groups, sulphonic acid ester groups, halogen-containing heterocyclic groups such as chlorotriazinyl, chloropyrazinyl, chloropyrimidinyl or chloroquinoxalinyl groups, activated double bonds such as those present in vinyl sulphonic derivatives or acrylic acid derivatives, amino groups, hydroxyl groups, isocyanate groups, olefin groups and acetylene groups, mercapto groups and epoxide groups, and alkyl or alkenyl groups with chain lengths of $C_8$ and upwards, in particular oleic, linoleic, stearic and palmitic groups.

Where fixing by a chemical reaction does not take place, adherence to the substrate surface may also be effected by adsorption of the organometallic activators to the surface, e.g. due to hydrogen bridge bonds or van der Waals forces.

The functional groups which effect adsorption should be suitably adapted to the particular substrate. Thus long chain alkyl or alkenyl groups in the activator molecule, for example, improve the adherence to substrates of polyethylene or polypropylene whereas activators containing additional carbonyl or sulphone groups, for example, are particularly suitable for metallising articles based on polyamides or polyesters.

Functional groups such as carboxylic acid groups and carboxylic acid anhydride groups are particularly suitable for fixing the activator to the substrate surface by adsorption.

The groups in the organic portion for binding the metal in the organo metallic compound are known per se. They may be, for example, C—C or C—N double or triple bonds or groups capable of forming a chelate complex, e.g. OH, SH, CO, CS or COOH groups.

The organometallic compound may be, for example, dissolved or dispersed in the organic solvent or it may be in the form of a triturate with the solvent.

If the organometallic compound contains ligands enabling the compound to be chemically fixed to the substrate surface, activation may also be achieved from the aqueous phase.

Without restricting the scope of the invention, however, it is advisable to observe the following preferred conditions when carrying out the process on an industrial scale:

1. The organometallic compounds used should be stable in air and in the presence of moisture. They should be readily soluble in organic solvents but only slightly soluble in water. Furthermore, they should be capable of being reduced by conventional reducing agents to a compound which acts as a catalyst in currentless metallisation.
2. The solutions of the organometallic compounds in organic solvents should be stable in air and in the presence of moisture.
3. The organic solvent should be easily removable.
4. Reduction of the organometallic compound must not be accompanied by the release of any ligands which would poison the metallising baths.
5. In aqueous solution, the reduced active nuclei should adhere firmly to the surface in order to prevent decomposition of the baths by metals carried into them.

The novel process according to the invention is generally carried out as follows:

The organometallic compound, in particular Cu, Ag, Au, Pd and Pt, containing an additional functional group is dissolved in an organic solvent. Mixtures of compounds may, of course, be used. The concentration of organometallic compound should be preferably from 0.01 g to 10 g per liter.

Particularly suitable organic solvents are polar, protic and aprotic solvents such as methylene chloride, chloroform, 1,1,1-trichloroethane, trichloroethylene, perchloroethylene, acetone, methylethyl ketone, butanol, ethylene glycol and tetrahydrofuran.

Mixtures of these solvents and mixtures with other solvents, such as petroleum hydrocarbons, ligroin, toluene, etc. may, of course, also be used. In the process according to the invention, the surfaces of the substrates to be metallised are wetted with these solutions, preferably for a period of from 1 second to 10 minutes. Methods such as immersion of the substrate in the activator solutions or spraying of the surfaces with the solutions are particularly suitable although in the process according to the present invention the activator solutions may, of course, also be applied by stamping or printing.

Suitable substrates for the process according to the invention include, for example, steel, titanium, glass, quartz, ceramics, carbon, paper, polyethylene, polypropylene, ABS polymers, epoxy resins, polyesters and textile sheets, threads and fibres of polyamide, polyester, polyolefins, polyacrylonitrile, polyvinyl halides, cotton or wool or mixtures thereof or of copolymers of the above mentioned monomers.

The organic solvent is removed after the wetting treatment. Low boiling solvents are preferably removed by evaporation, e.g. under vacuum. Other methods may be more suitable for higher boiling solvents, such as extraction with a solvent in which the organometallic compound is insoluble.

The surfaces which have been pretreated as just described must be activated by reduction, advantageously using the usual reducing agents employed for electroplating, such as hydrazine hydrate, formaldehyde, hypophosphite or boranes. Other reducing agents could, of course, also be used. Reduction is preferably carried out in aqueous solution although other solvents, such as alcohols, ethers, or hydrocarbons, may also be used. The reducing agents may, of course, also be used in the form of suspensions or dispersions.

When the surfaces have been activated as just described, they are ready for currentless metallisation but it may be necessary first to clean the surfaces by rinsing to free them from residues of the reducing agent.

In one particularly preferred embodiment of the process according to the invention, reduction is carried out in the metallising bath, using the reducing agent of currentless metallisation. This method provides a hitherto unattainable simplification of currentless metallisation. This very simple procedure now consists of only three steps: immersion of the substrate in the solution of the organic compound, evaporation of the solvent and immersion of the thus activated surfaces in the metallising bath (reduction and metallisation).

This embodiment is particularly suitable for nickel baths containing aminoborane and copper baths containing formalin.

The metallising baths used in the process according to the invention are preferably baths containing nickel salts, cobalt salts, copper salts, gold and silver salts or mixtures of these salts with each other or with iron salts. Metallising baths of this kind are known for use in currentless metallisation.

The process according to the invention has the advantage that the metal deposited by subsequent currentless metallisation will adhere firmly even without prior etching of the substrate surface. On the other hand it is frequently advantageous to swell or dissolve the substrate surfaces by treating them with suitable solvents, without—as is the case with etching—substantially changing the polymer substrates chemically or even disintegrating them.

Such processes are generally known and are described for example in the following patent literature: U.S. Pat. Nos. 3,574,070, 3,445,350 and 3,574,070 and GB PS No. 1124556.

According to a particularly preferred variant of the process according to the invention the activation and the swelling or dissolving are carried out in one process step, by homogeneously distributing the organo-metallic compound use for the activation in these solvent systems which consist of swelling agents or solvents for the polymer substrate to be metallised.

The organometallic activators can be in the form of true solutions, emulsions or suspensions.

By the action of the activator systems, with their characteristic swelling action, on the substrates a kind of "adhesive nucleation" is achieved which can perhaps be visualized in such a manner that intermediate spaces form on the substrate surface which are accessible for the activating nuclei and to which the metals deposited by the currentless metallisation are firmly fixed.

The change in the surface produced by the "swelling adhesive nucleation" becomes noticeable through a change in the light scattering, opacity, transparency (in the case of transparent films and sheets), a change in the layer thickness or—in scanning electron microscopic photographs—in the form of cracks, pits or vacuoles.

The swelling agents suitable for the polymer substrate to be metallized in each case have to be determined from case to case by appropriate preliminary tests. A swelling agent is most effective when it swells the surfaces of the substrates within reasonable periods of time without completely resolving the substrate or even merely negatively influencing its mechanical properties such as its impact strength and without changing the organometallic activators.

Suitable swelling agents are, in addition to the solvents indicated in the above-mentioned patent literature for example the so-called O-solvents or mixtures thereof with precipitants, such as are described for example in "Polymer Handbook", J. Brandrup et al, New York, IV 157–175 (1974).

Suitable swelling agents or solvents are lower and higher alcohols, aldehydes, ethers, ketones, halogenated hydrocarbons, simple or saturated hydrocarbons, organic acids, esters or their halogenated derivatives, liquid gases such as butane, propylene and 1,4-cis-butadiene.

Mixtures of these solvents and mixtures with other solvents, such as benzine, ligroin, toluene, n-hexane etc. can alco of course be used. In order to achieve an improved interaction betewen the substrate surface and the adhesive nucleation medium, such media can be provided with organic and/or inorganic additives. For this purpose anionic emulsifiers such as for example alkali metal salts of palmitic acid, stearic acid, oleic acid or salts of sulphonic acids which are prepared by sulphochlorination on the basis of paraffins containing 6–20 carbon atoms; nomaric emulsifiers, which can for example be prepared by the ethoxylation of long-chain alcohols or phenols; cationic emulsifiers, such as for example salts of long-chain, in particular unsaturated amines with 12 to 20 C-atoms or quaternary ammonium compounds with long-chain olefins or paraffin esters; protective colloids on the basis of macromolecular compounds, such as for example gelatins, pectins, alginates, methyl cellulose, ionic and neutral polyurethane dispersions or their oligomeric derivatives, polyvinyl alcohols, polyvinyl pyrrolidone and polymethyl vinyl acetate; finely divided water-soluble minerals such as alumina, kieselguhr and calcium phosphate; and alkali metal and alkaline earth metal salts $CaCl_2$, $MgSO_4$ or $K_3PO_4$ are very suitable.

The quantity of the above-indicated additives can, based on the medium present, be varied from 0.01 to 20% by weight.

In order to increase the stability of the organometallic activators in the organic media it can be necessary to additionally add up to 10% of dimethyl formamide formamide, dimethyl sulphonide or tetramethyl urea to these.

In order to increase the adhesion nucleation effect of the organic media it can be necessary to additionally add organic compounds such as $Cl_2$, HCl, $H_2O$, HF, HJ, $H_2SO_4$, $H_3PO_4$, $H_3PO_3$, $H_3SO_3$, boric acid, NaOH or KOH to these media. The quantities of these organic compounds can be varied from 0.1 to 30% by weight (based on the medium concerned, it being possible for the added quantities of organic compounds in some cases to be higher or lower. In order to obtain uniform distribution of these inorganic additives in the organic media it can be necessary to add small amounts of water to the organic media as solubilizers.

In the process according to the invention the surfaces of the substrates to be metallized are wetted with these media, the reaction time being preferably from 1 second to 90 minutes. Particularly suitable for this purpose are methods such as immersing the substrate in the media, or spraying the substrate surfaces with the activating media or applying these to the substrate surfaces by vapour deposition.

Furthermore it is also possible in this adhesion nucleation process to apply the activating solutions by stamping or by pressure processes.

The adhesive nucleation according to the invention can be carried out at temperatures of −20° C. to 100° C., lower temperatures preferably being used in the case of low-boiling solvents and substrates which are readily chemically attacked, chemically resistant substrates on the other hand requiring higher temperatures. In exceptional cases adhesive nucleation can also be carried out at lower or higher temperatures, below −20° C. or higher than 100° C. Temperatures of 0° C. to 80° C. are preferred.

After the substrate surfaces have been wetted the solvent is removed as described above.

In order to increase the deposition rate of the metallization reaction additional activation of the substrate surfaces can be carried out in an activation medium which is a precipitant for the polymer material. Such precipitants are known and can be found in the already mentioned "Polymer Handbook", IV, 241–267.

EXAMPLE 1

A knitted square of polyester polymer (100% polyethylene terephthalate) measuring 10×10 cm is dipped for 10 seconds at room temperature in an activating bath prepared from 0.4 g of 4-cyclohexene-1,2-dicarboxylic acid anhydride-palladium (II) chloride and 1 litre of $CH_2Cl_2$, dried at room temperature and then nickel plated for 10 minutes, by a currentless process of metallisation in an aqueous alkaline nickel plating bath containing 3.5 g of dimethyl aminoborane, 30 g of nickel chloride and 10 g of citric acid per litre and adjusted to pH 8.2 with concentrated ammonia solution. The surface takes on a metallic gloss and colour after about 60 seconds and 12 g/m$^2$ have been deposited after 10 minutes.

EXAMPLE 2

An injection moulded ABS plate of acrylonitrile/-butadiene/styrene graft copolymer measuring 150×100 mm is degreased in an aqueous 15% by weight sodium hydroxide solution, neutralised with distilled water, dipped for 30 seconds in an activator solution of 0.8 g of 4-cyclohexene-1,2-dicarboxylic acid anhydride-silver-(I) nitrate in 1 liter of methanol, dried at room temperature and then nickel plated as described in Example 1. The sample is found to be covered with a very fine layer of nickel after only 60 seconds. After approximately 10 minutes, the chemical nickel layer has an average thickness of ca. 0.20 μm. After the sample had been removed from the chemical metallising bath and rinsed with distilled water, it was connected as cathode into a galvanic copper plating bath and its thickness was increased to ca. 6.6 um by electroplating for 30 minutes at 0.5 A/dm$^2$.

EXAMPLE 3

A square of cottom fabric measuring 120×120 mm is activated for 20 seconds in the manner described in Example 1 and then nickel plated. The material acquires a metallic gloss and is covered with approximately 11% by weight of nickel.

EXAMPLE 4

A rectangular piece of polyester foil measuring 35×100 mm is activated for 20 seconds as described in Example 1 and nickel plated for 7 minutes after evaporation of the solvent. The resulting foil has a metallic gloss and is covered with a layer of nickel 0.15 μm in thickness.

EXAMPLE 5

A rectangular piece of roughened polycarbonate foil measuring 40×60 mm containing 10% by weight of polybutadiene is dipped into a solution of 0.5 g of 4-cyclohexene-1,2-dicarboxylic acid anhydride palladium-dichloride in 1 liter of methanol, dried and then nickel-plated as described in Example 1.

A firmly adhering layer of nickel ca. 0.2 μm in thickness with a metallic gloss is found to be deposited after 7 minutes. This layer was connected as cathode into a galvanic copper plating bath and reinforced with galvanic copper to a thickness of 30 μm at 1.0 ampere acting for 30 minutes. The galvanic copper plating bath had been prepared from 200 g to $CuSO_4$ and 30 g of $H_2SO_4$ (96%) made up to 1 liter with distilled water.

EXAMPLE 6

A square of cotton fabric measuring 150×150 mm is dipped into a solution of 0.5 g of isobutyl vinyl ether palladium dichloride in 1 liter of 1,1,1-trichloroethane for 30 seconds, dried at room temperature and nickel-plated for 20 minutes in a nickel bath as described in Example 1.

The surface begins to darken after about 20 seconds and a nickel layer with a metallic gloss is found to be deposited after 10 minutes.

EXAMPLE 7

A square of glass-fibre-reinforced epoxide resin plate measuring 100×100 mm is sprayed with a solution of 0.6 g of isobutyl vinyl ether palladium dichloride in 1 liter of 1,1,1-trichloroethane, dried at room temperature and then nickel plated in a chemical nickel bath as described in Example 1. The surface of the plate begins to darken after only about 30 seconds and is covered with a fine nickel layer after 60 seconds. After approximately 10 minutes, the chemically deposited nickel layer has a thickness of ca. 0.2 μm.

EXAMPLE 8

A rectangular piece of polyethylene plastics measuring 150×50 mm is dipped into an activating bath prepared from 0.75 g of 9-octadecene-1-ol-palladium chloride and 1 liter of 1,1,1-trichloroethane and then nickel plated in a chemical nickel bath as described in Example 1.

The piece of plastics which now has a metallic gloss is connected as cathode into a galvanic semi-gloss nickel plating bath in which its thickness is increased to ca. 8.1 μm under a current of 1 amp acting for 30 minutes at 50° C.

The organometallic compounds used in the examples are obtained as follows:

4-cyclohexene-1,2-dicarboxylic acid anhydride-palladium-(II) chloride:

4-cyclohexene-1,2-dicarboxylic acid anhydride is dissolved in three times its quantity of dimethyl formamide. Its equimolar quantity of acetonitrile palladium dichloride is added at 40° C. in the course of 2 hours. Dimethyl formamide and acetonitrile are distilled off at 45° C./25 mbar. A brownish solid with a melting point of 53°-54° C. is obtained in a 90% yield. Isobutylvinyl ether palladium dichloride is obtained in analogous manner from acetonitrile palladium dichloride and isobutyl vinyl ether, melting point 57°-60° C.

EXAMPLE 9

A plastic sheet of polyamide 6/6 having the dimensions 15×10 cm and a thickness of 3 mm is degreased in 25 % sodium hydroxide solution at room temperature. Then the plastic sheet is immersed for one minute in an adhesive nucleation solution which contains 67.5 % by volume of methanol, 22.5 % by volume of methylene chloride, 10 % of chloral hydrate and 0.3 g/l of butadiene palladium chloride. The thus activated substrate is dried and then immersed in a currentless nickel-plating bath which contains 25 g/l of nickel chloride, 3 g/l of dimethylaminoborane and 10 g/l of citric acid and has been adjusted to pH 7.9 with ammonia. After 20 minutes a uniform glossy nickel layer is deposited. The adhesion, determined by the stripping force in accordance with DIN 53494 is 7.7 N/2.5 cm.

EXAMPLE 10

A plastic sheet according to Example 9 is degreased at room temperature in 25 % sodium hydroxide solution. Then it is immersed for 5 minutes in an adhesive nucleation solution which consists of 72.5 % by volume of dimethyl formamite, 22.5 % by volume of water, 5 % by volume of 37 % aqueous HCl and 0.3 g/l of butadiene palladium dichloride. Then the sample is nickel-plated for 60 minutes in a metallisation bath according to Example 9. A uniform matt nickel surface is obtained for which the stripping force in accordance with DIN 53494 is no longer able to be determined since the adhesion of the nickel layer thickened by electroplating is greater than the tensile strength of the metal film.

EXAMPLE 11

A polyamide 6/6 sheet according to Example is degreased at room temperature with 25 % of sodium hydroxide solution. The the sheet is immersed for 10 minutes in a solution which contains 40 g/l of calcium chloride and 0.3 g/l of butadiene palladium chloride in 80% by volume of methanol and 20% by volume of methylene chloride. The the sheet is dried with a cloth and then nickel-plated in a metallisation bath according to Example 9 for 20 minutes. A uniform, glossy nickel layer is obtained. Adhesion after thickening by electroplating is also not able to be determined for this sample since the required stripping force is higher than the tensile strength of the metal coating.

EXAMPLE 12

A test sheet of 10×15 cm, with a layer thickness of 3 mm, of a polyamide 6 plastic reinforced with 10% of minerals is degreased with 25% sodium hydroxide solution at room temperature. Then the sheet is immersed for one hour in a solution which contains 100 g of calcium chloride and 0.3 g of bis-(allylpalladium)-dichloride per liter of methanol. The sheet is washed with methanol dried and then immersed in a currentless nickel-plating bath according to Example 9. After 20 minutes a uniform matt nickel layer is deposited. After thickening by electroplating the stripping force of the metal coating is greater than the tensile strength of the metal layer.

EXAMPLE 13

A polymer sheet of polyamide 6 containing 30 % by weight of glass fibres is degreased at room temperature in 20% sodium hydroxide solution. Then it is immersed for 8 minutes in an adhesive nucleation solution which consists of 40% by weight of hydrochloric acid (37% purity), 60% by weight of methanol and 0.9 g/l of 4-cyclohexene-1,2-dicarboxylic acid anhydride palladium (II) chloride. Then the sample is nickel-plated for 20 minutes in a metallisation bath which contains 30 g/l of nickel sulphate, 3.8 g/l of dimethyl amminoborane and 10 g/l of citric acid and is adjusted to a pH of 7.6 with concentrated aqueous ammonia solution. The adhesion of the metal layer, which is determined by the stripping force in accordance with DIN 53494, is 6N/2.5 cm.

EXAMPLE 14

A polymer sheet of polyamide 6 with 35 % by weight of a butadiene graft polymer is degreased at room temperature in 15% sodium hydroxide solution. Then it is activated for 10 minutes in a bath which is prepared from 90 g HCl (37 %purity), 410 g ethylene glycol and 0.5 g of 4-cyclohexene-1,2-dicarboxylic acid anhydride palladium (II) chloride, and then metallized in a metallization bath according to Example 13 in the course of 20 minutes.

After thickening by electroplating the stripping force of the metal coating is greater than the tensile strength of the metal layer.

EXAMPLE 15

A test sheet of 10×10 cm with a layer thickness of 3 mm, of an ABS (acrylonitrile/butadiene/styrene) plastic is degreased at room temperature with 22% sodium hydroxide solution. Then the sheet is immersed for 10 minutes in a solution which contains 700 ml methanol, 100 ml of ethyl acetoacetate, 50 ml of DMF (dimethyl formamide) and 0.9 ml of 4-cyclohexene-1,2-dicarboxylic acid anhydride palladium(II)chloride. The sheet is washed with methanol, dried and then metallised in a currentless nickel-plating bath according to Example 13. After 25 minutes a uniform, matt nickel coating has been deposited. The adhesion determined by the stripping force according to DIN 53494, is 5 N/2.5 cm.

We claim:

1. A process for the activation of substate surfaces for the purpose of currentless metallization, consisting essentially of the steps in which the surface to be metallized is treated with an activator compound homogeneously distributed in a solvent, the solvent is removed and the activator compound adhering to the surface to be metallized is reduced by use of a reducing agent contained in the metallization bath wherein the treating of the substrate surface with activator compound and solvent removal are effected at 0° to 80° C. and the activator compound is a palladium dichloride complex which exhibits at least one ligand containing a group with C—C or C—N double or triple bond or a group capable of chelate formation selected from OH, SH, CO, CS, or COOH for binding the metal therein and at least one ligand containing a carboxylic acid group, carboxylic acid halide group, carboxylic acid anhydride group, carboxylic acid ester group, carboamide group, carbonimide group, aldehyde group, ketone group, ether group, sulphoamide group, sulphonic acid group, sulphonate group, sulphonic acid halide group, sulphonic acid ester group, halogen-containing heterocyclic group, activated double bond, amino group, hydroxyl group, isocyanate group, olefin group, acetylene group, mercapto group or epoxide group for fixing the activator compound to the substrate surface.

2. A process according to claim 1, wherein the additional functional groups are carboxylic acid and carboxylic acid anhydride groups.

3. A process according to claim 1, wherein the organometallic compound is dissolved or dispersed in the solvent in a quantity of from 0.01 to 10 g/liter.

4. A process according to claim 1, wherein the solvent is a pure organic solvent or mixtures or blends of several organic solvents.

5. A process according to claim 1, wherein the substrate is activated without prior etching.

6. A process according to claim 1, wherein the substrate surface is treated with a swelling agent.

7. A process according to claim 1, wherein the swelling agent is in the activating bath.

8. A process according to claim 1, wherein the swelling agent used is a O-solvent or mixtures thereof with precipitants.

9. A process according to claim 1, wherein the swelling agent additionally contain emulsifiers and/or water-soluble minerals or organic and/or inorganic acids such as HCl, $CH_3COOH$ or $CHO_2H$.

10. A process according to claim 1 wherein the wetting is effected at 0° to 80° C.

11. A process according to claim 1, wherein the treating is effected at room temperature.

12. A process according to claim 1, wherein the activator compound exhibits at least one ligand containing a C—C double bond and at least one ligand containing a dicarboxylic acid anhydride group, a C—C double or an ether group.

13. A process according to claim 1, wherein the activator compound is cyclohexene-1,2-dicarboxylic acid anhydride palladium dichloride.

14. A process according to claim 1, wherein the activator compound is butadiene palladium dichloride.

15. A process according to claim 1, wherein the activator compound is isobutyl vinylether palladium dichloride.

16. A process according to claim 1, wherein the activator compound is bis-(allyl) palladium dichloride.

17. A process according to claim 3, wherein the activator compound is dissolved in the solvent.

* * * * *